US005149227A

United States Patent [19]

Parks

[11] Patent Number: 5,149,227

[45] Date of Patent: Sep. 22, 1992

[54] BEACH STABILIZATION WITH MULTIPLE FLOW CONTROL

[76] Inventor: James M. Parks, 3509 Merrick Ct., #210, Lexington, Ky. 40502

[21] Appl. No.: 696,044

[22] Filed: May 6, 1991

Related U.S. Application Data

[63] Continuation-in-part of Ser. No. 488,683, Mar. 5, 1990.

[51] Int. Cl.[5] ..... E02B 3/06; E02B 8/02

[52] U.S. Cl. ..... 405/73; 405/15; 405/21; 405/43; 405/50

[58] Field of Search ..... 405/73, 74, 52, 21, 405/43, 45

[56] References Cited

U.S. PATENT DOCUMENTS

| | | | |
|---|---|---|---|
| 2,158,046 | 5/1939 | Prendergast | 405/74 X |
| 3,638,432 | 2/1972 | Schoonmaker | 405/74 |
| 3,686,887 | 8/1972 | Bruce | 405/74 X |
| 4,645,377 | 2/1987 | Vesterby | 405/74 X |
| 4,898,495 | 2/1990 | Lin | 405/74 X |

*Primary Examiner*—Dennis L. Taylor
*Attorney, Agent, or Firm*—Charles A. McClure

[57] ABSTRACT

Beach stabilization with multiple flow control of water to and from foraminous pipes and adjacent subsoil. Offshore underwater subsoil is fluidized by injection of water via underlying foraminous piping, thereby increasing the concentration of subsoil suspended in the overlying water during its onrush onto the shore. Under normal conditions beach subsoil is dewatered by withdrawing water therefrom via adjacent foraminous piping, and under stormy conditions subsoil further onshore is dewatered via foraminous piping adjacent thereto, inducing deposition of the suspended subsoil onto the adjacent land. Water collected by such dewatering can be used in such fluidization.

17 Claims, 3 Drawing Sheets

BEACH STABILIZATION WITH MULTIPLE FLOW CONTROL

This is a continuation-in-part of my copending application, Ser. No. 488,683, filed Mar. 5, 1990, which is incorporated herein in its entirety by this reference.

TECHNICAL FIELD

This invention relates to stabilization of beaches, including control of sand washing onshore and of sand backwashing offshore.

BACKGROUND OF THE INVENTION

My aforementioned patent application includes an overview of subsoil dewatering as a method of enhancing and stabilizing beaches subject to erosion by the action of waves, tides, or other currents.

Under normal conditions, nature's transport of non-cohesive subsoil (such as sand) periodically to and onto a beach and off or away from the beach is at—or close to—equilibrium (zero net transport). whereupon little or no cumulative change in beach extent is noticed. Seasonal or other variations may tend to remove sand (erosion by negative net transport) or to replace it (accretion by positive net transport) for substantial periods of time but often average out over a few years if not during each individual year. However, some undergo consistent beach accretion or beach loss for many years. Beach accretion is hardly ever a cause for concern, but continuing or repeated beach erosion occasions financial and esthetic losses, greatly disturbing landowners, municipalities, tourists, etc.

As detailed in my mentioned patent, dewatering of the beachface at a level just below mean low water is beneficial by removing part of the overlying water in which non-cohesive subsoil is suspended, thereby increasing the concentration of suspended subsoil in the suspending water, whereupon a bit more of such subsoil than usual is deposited on the beachface during wave onrush and a bit less than usual is removed during the ensuing backwash. Such dewatering need not be continuous but only sufficiently often to assure that on the average the beach receives as much sand as it loses.

Some of the worst beach erosion occurs suddenly, during storms in which great expanses of beach are carried away, The disruptive effect of storms may be ameliorated somewhat by building a beach outward during normal times to provide a buffer or sacrificial zone. Retention of excess sand on the beach so as to appease nature's appetite when on a rampage is generally prudent and much better than periodically dredging up sand and depositing it onto the beach, only to be carried off in a few months. Whether the most violent storms can be neutralized is doubtful, but the present invention not only extends my previous invention to enhance day-to-day net accretion but also modifies its means and methods to reduce storm loss.

SUMMARY OF THE INVENTION

A primary object of the present invention is to counteract the capacity of a storm for carrying off much of the sand from a beach.

Another object of this invention is to stabilize a beach by increasing the amount of sand washing onshore.

A further object of the invention is to stabilize a beach by decreasing the amount of sand backwashing offshore.

Yet another object of this invention is to provide standby or back-up emergency capacity to a beach subsoil dewatering system.

A further object is to combine emergency subsoil dewatering with offshore subsoil fluidization to obtain extraordinary benefits.

In general, the objects of the present invention are attained, in stabilizing beaches, by the steps of dewatering beach subsoil to maintain beach extent without substantial net loss of under normal conditions, also dewatering subsoil between the beach and wave runup above the beach under stormy conditions, and preferably fluidizing sandy subsoil offshore to increase subsoil concentration in waves.

More particularly, such objects are accomplished by burying first foraminous piping means in subsoil between the mean high water (MHW) margin of the beach and the furthest onshore storm wave runup location, valved to dewater onshore subsoil in storm conditions and thereby ameliorate storm loss of beach extent; and burying second foraminous piping means in beach subsoil in the vicinity of the mean low water (MLW) margin of the beach, valved to dewater the overlying subsoil and thereby preclude substantial net loss of subsoil under normal conditions and/or valved to fluidize beach subsoil to increase subsoil concentration in onrushing storm waves; and burying third foraminous piping means offshore from MLW, valved to dispose of water resulting from beach dewatering and/or valved to fluidize subsoil and thereby increase its concentration in waves washing onto the beach. Water flow into, through, and out of the piping means is aided by inclusion of one or more pumping means. The valves and the pumping means are actuated by conventional electrical, pneumatic, hydraulic, or simple mechanical means and methods in accordance with ambient conditions and/or preselected timing cycles.

Other objects of the present invention, together with means and methods for attaining the various objects, will be apparent from the following description and accompanying diagrams of preferred embodiments, which are presented by way of example rather than limitation.

DESCRIPTION OF THE INVENTION

Figure 1:
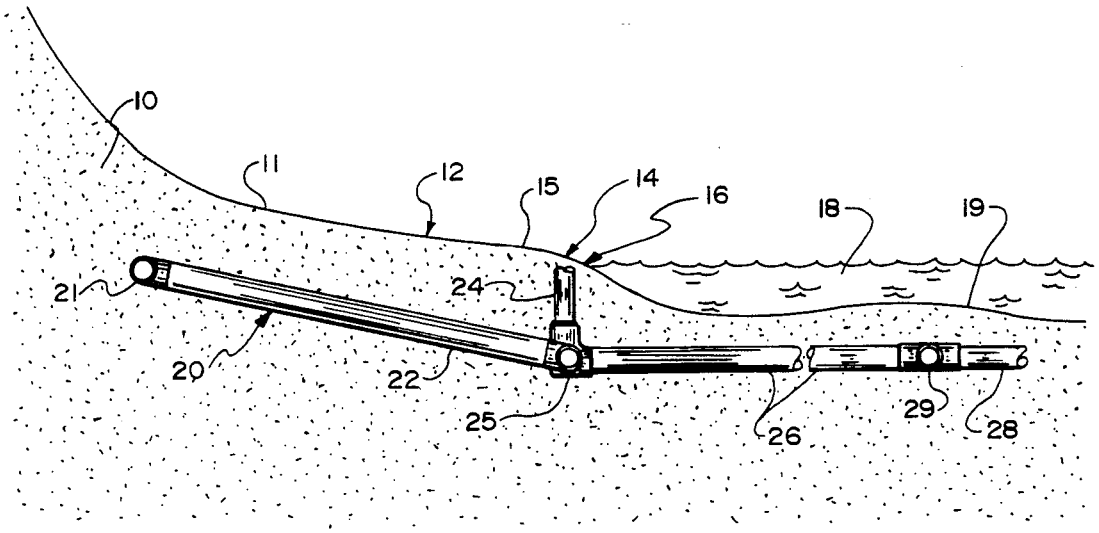
FIG. 1 is a side sectional elevation of apparatus of this invention underlying a beach and its vicinity, both onshore and offshore.
Figure 2:
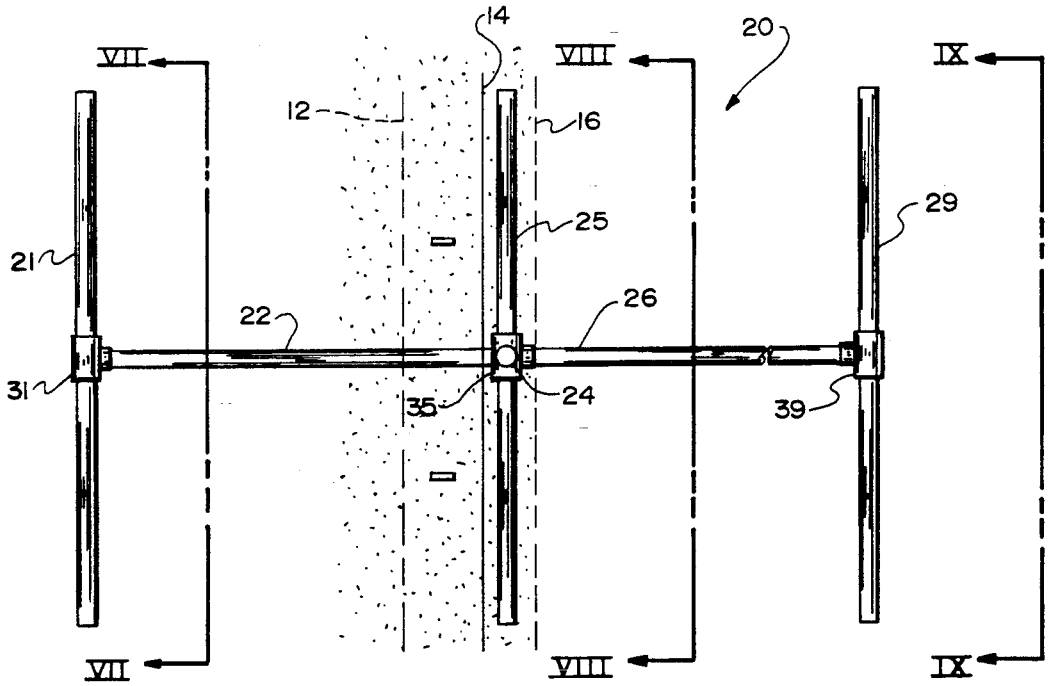
FIG. 2 is a plan view corresponding to FIG. 1.
Figure 3:
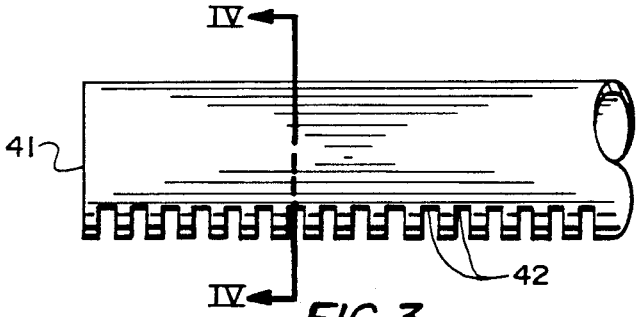
FIG. 3 is a side elevation of a first embodiment of piping useful according this invention.
Figure 5:
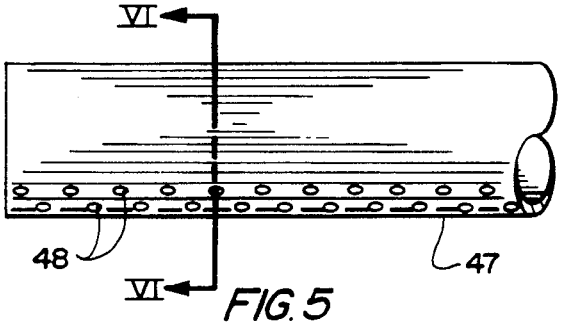
FIG. 5 is a transverse sectional view of a second embodiment of piping useful according to this invention.

FIG. 1 shows in schematized side sectional elevation, and FIG. 2 shows in plan, piping assembly 20 of this invention, installed underlying onshore surface 11 (bordered at the left by dune 10), beach surface 15 sloping from mean high water MHW) 12 through mean sea level (MSL) 14 to mean low water (MLW) 16, then offshore into water 18 as underwater surface 19. The major piping assembly components (all underground) include foraminous onshore pipe 21 and beach pipe 25 and also offshore pipe 29, substantially parallel to one another and an average contour. These foraminous pipes are orthogonal to interconnecting non-foraminous pipe 22 (between foraminous pipes 21 and 25), and pipe 26 (between foraminous pipes 25 and 29), and discharge pipe 28—partially cut away. Pipe fittings retain the respective pipes in place: three-way fitting 31 joining pipes 21 and 22 (both ends); five-way fitting joining pipes 22, 24, 25 (both ends), and 26; and four-way fitting joining pipes 26, 28, and 29 (both ends). The fittings accommodate valving and pumping means (not visible here) for controlling flow of water from one or more of the pipes to one of more of the other pipes, as shown schematically in later views (FIGS. 3 and 5 partly, and 10 in more detail). Sight lines VII, VIII, and IX correspond to respective pairs of views in subsequent FIGS. 7A, 7B; 8A, 8B; and 9A, 9B—considered later below.

Figure 4:
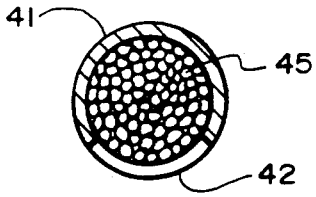
FIG. 4 is a front sectional elevation of the piping embodiment of FIG. 3.

FIGS. 3 and 4 show in respective side elevation and end section first foraminous piping embodiment 41 having its otherwise solid wall notched transversely at intervals on its underside to a maximum depth of a minor part of its diameter, thus providing openings (foramina) 42 through the lower portion of the pipe. The interior is preferably packed with solid granular or pebbly material 45 too large (or too coherent) to escape through the openings.

Figure 6:
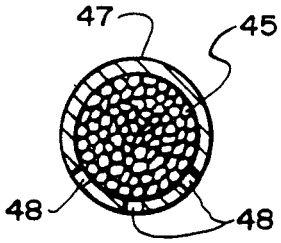
FIG. 6 is a front sectional elevation of the piping embodiment of FIG. 5.

FIGS. 5 and 6 show in respective side and end elevation second foraminous piping embodiment 47 having the lower part of its otherwise solid wall perforated at intervals to provide openings (foramina) 48 therethrough. As in the previous embodiment, its interior is shown packed with granular or pebbly material 45.

Figure 7A:
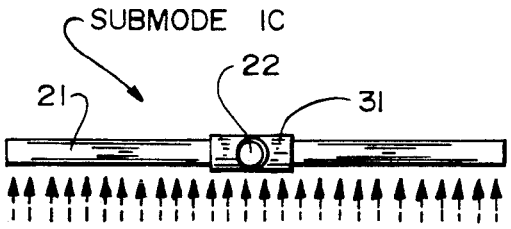
FIGS. 7A, 8A, and 9A are schematic operational representations one major mode of onshore, beach, and offshore piping operation.
Figure 8A:
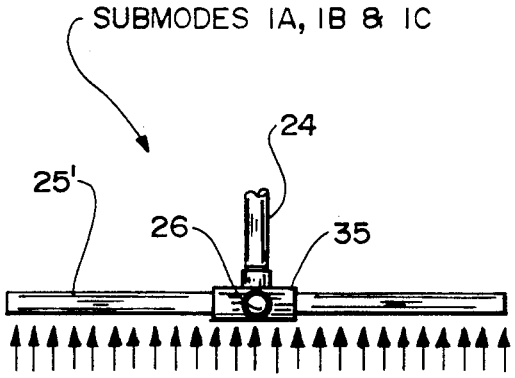
Figure 9A:
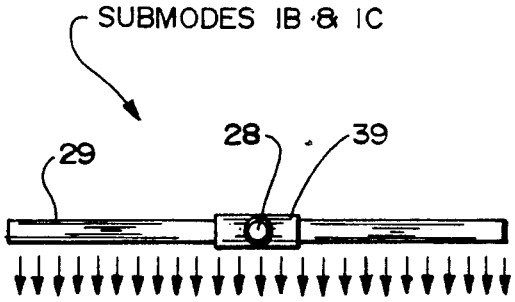

FIGS. 7A, 8A, and 9A show schematically respective foraminous pipes 21, 25 (designated here as 25'), and 29 with arrows juxtaposed to the underside in each instance: pointed upward to pipes 21 and 25' to signify dewatering use, and pointed downward from pipe 29 to denote fluidizing use. This set of views illustrates use in normal or modestly stormy conditions. The arrows in FIG. 7A are broken to suggest that use thereof in non-stormy conditions is unlikely.

Figure 7B:
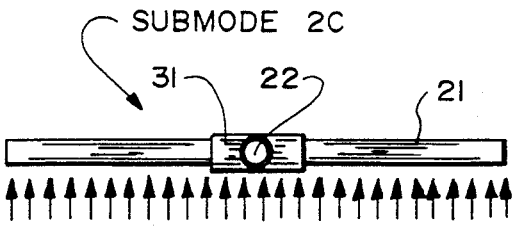
FIGS. 7B, 8B, and 9B are similar schematic representations of another major mode of onshore, beach, and offshore pipe operation.
Figure 8B:
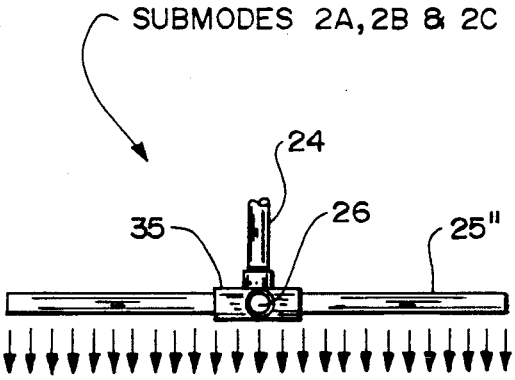
Figure 9B:
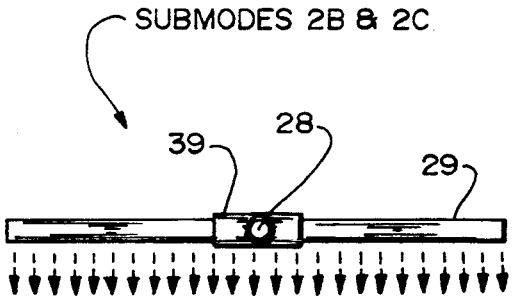

FIGS. 7B, 8B, and 9B show schematically respective foraminous pipes 21, 25 (designated here as 25''), and 29 again with juxtaposed arrows: upward to pipes 21 to signify dewatering use, and downward from pipes 15'' and 29 to signify fluidizing use. The FIG. 9B arrows are broken to suggest unlikely use in very stormy conditions.

Figure 10:
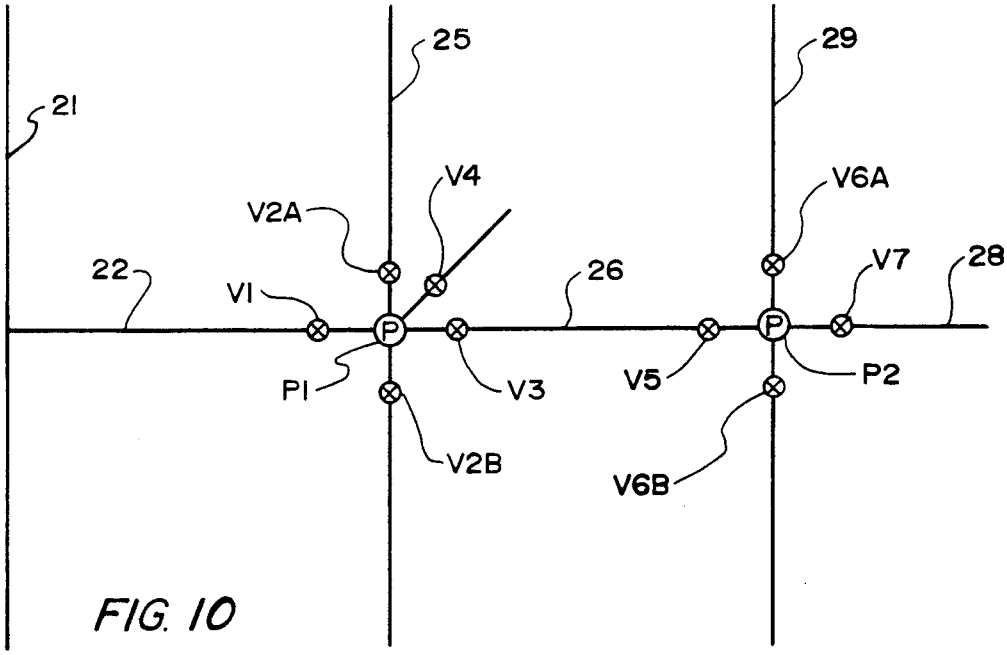
FIG. 10 is a schematic diagram of valves and pumps in relation to the exemplified piping.

FIG. 10 is a schematic diagram of valving and pumping means for the illustrated piping arrangement (in single lines). The onshore junction of foraminous pipe 21 (both sides) and non-foraminous pipe 22 is valve-free. Pump P1 is shown at the beach junction of pipes 22, 24 (upward), and 25 (both sides), and 26. Valve V1 is in non-foraminous pipe 22 near the beach pipe junction; valves V2A and V2B flank the junction between the flanking parts of foraminous pipe 25; valve V4 is in foraminous pipe 26 near (above) the junction; and valve V3 is nearby in non-foraminous pipe 26. Pump P2 is at the offshore junction of pipes 26, 28, and 29 (both sides). Valve V5 is in non-foraminous pipe 26 near the offshore junction, valves V6A and V6B in foraminous pipe 29 flank the offshore junction, and valve V7 is in non-foraminous pipe 28 near the junction.

The invention is exemplified by the illustrated arrangement of three substantially parallel foraminous pipes linked along a single line of non-foraminous piping, but it will be understood that either or both the foraminous or/and the non-foraminous pipes may have like neighboring piping parallel thereto in a matrix replication thereof, along with additional pumps to assure the desired flow pattern(s).

No unusual materials are required for practicing this invention although conventional materials may be modified or new ones be devised. Non-foraminous plastic pipe may be slotted or notched to provide the first embodiment of foraminous pipe, or it may be perforated in any suitable manner to provide the second pipe embodiment. As shown, either style of pipe may be filled with granular or pebbly material to weigh it down into position and to hold it in such position, and to aid in excluding undesired organic and inorganic contaminants from entering the pipes. Otherwise, metal piping may be employed, with or without such filling material inside it.

For low cost and ready handling, plastic pipe is preferable to metal pipe at least some, if not all, of the time. Appropriate compositions include high-density polyethylene (HDPE) or polypropylene (HDPP) and polyvinyl chloride (PVC). In some heavy-duty uses, epoxy pipe reinforced with glass-fibers is another possible choice.

Foraminous plastic pipe may be available, but (if not) perforated plastic sheets can be rolled to juxtapose its opposite edges into cylindrical form and be seamed along juxtaposed edges by adhesive or heating for ready conversion into piping. End-to-end attachment may be accomplished by use of sleeves or bands of similar or dissimilar material assembled with surrounding end-to-end sleeves or bands clamped or sealed about juxtaposed ends of pipes.

Tee and cross fittings are also readily available in suitable materials to make up simple and complicated piping arrangements. If more complex (e.g., five-way) fittings are not at hand they may be built up from simpler fittings by appropriate interconnection of the standard fittings, as is well known.

Some pumps have multiple—even reversible—intake and discharge ports and valves, and thus are especially convenient for use according to this invention. In their absence, additional pumps may prove less expensive and more convenient, and their interconnection to the pipes and valves readily apparent, as is customary in flow control. It is assumed here that a non-operating pump offers minor resistance to flow therethrough, whether occasioned by gravity or another pump, so if a selected pump would offer excessive resistance, a suitable bypass arrangement can be provided when the pump is not running.

Pumps and valves are most commonly operated electrically, but hydraulic or pneumatic actuation may be substituted. It is usually inconvenient, though it may be possible, to rely upon on-site manual operation of valves. No attempt is made in the accompanying drawings to show interconnection of electrical, hydraulic, or pneumatic lines for—or to—pumps or valves, as appropriate means and methods for doing so will be obvious to persons ordinarily skilled therein.

Operation of the apparatus of the invention to practice methods of the invention will be apparent from the foregoing description and the accompanying diagrams, in the light of the following summary of the respective operating modes whose main features are illustrated in FIGS. 7A, 8A, 9A for operating Mode I, and are illustrated in FIGS. 7B, 8B, 9B for operating Mode II. As a rule of thumb, which is only advisory rather than mandatory, Mode I is recommended during fair to moderately unsettled weather conditions, and Mode II during stormy to very stormy conditions. Each operating mode has major submodes, each of which also has submodes, some of which are described. In the best circumstances (Mode 0) the apparatus is held in stand-by condition, not actually transferring any water but ready to do so.

In Mode I, with only pump P1 operating, valve V1 is closed, and valves V2A and V2B are open to P1 intakes, so the subsoil underlying the beach is dewatered via intermediate foraminous pipe 25, either without offshore fluidization (FIG. 8A only, major submode IA) or with offshore fluidization (FIG. 9A as well, major submode IB).

In submode IA1, with valve V4 open in pump discharge setting and valve V3 closed, collected water is forwarded via vertical pipe 24 for such subsequent treatment as desalination or purification and/or use elsewhere or is stored (as in a standpipe or reservoir) for future fluidizing use according to this invention, as in storms.

In submode IA2, with valve V4 closed and valve V3 open in pump discharge setting, and with valves V5 and V7 also open, the collected water is discharged offshore via pipe 28 with pump P2 idle, or further offshore with pump P2 actively forwarding it.

In submode IB1, valve V7 is closed, whereupon the collected water passes through Pump P2 (now preferably operating) and through open valves V6A and V6B into and laterally out of foraminous pipe 29, thereby fluidizing the adjacent subsoil and increasing subsoil concentration in the overlying water. In submode IB2, valve 7 is open, so that pump P2 draws water in from offshore, as well as forwarding water from beach dewatering, into and out of foraminous pipe 29 to fluidize the adjacent subsoil.

In submodes IC1 and IC2, valve V1 is opened, whereupon onshore dewatering (FIG. 7A) supplements beach (FIG. 8A) dewatering, without or with (FIG. 9A) offshore fluidization. These submodes are useful when waves run up much higher than MHW, especially in the absence of conditions such as may suggest a shift over to Mode II operations. Indeed, these presumably less likely operating submode may be thought of as intermediate between the previous submodes of Mode I and Mode II or as a transition to Mode II, which is described next.

Mode II has as an additional objective to increase subsoil concentration in the furthest onshore runup area and thereby enhance deposition of suspended subsoil thereon before backwash. Valve V1 is open, so onshore dewatering occurs (FIG. 7B). Valves V2A and V2B are connected into discharge instead of intake ports of pump P1, which is now drawing water from pipe 21, so that beach dewatering is replaced by beach fluidization (FIG. 8B).

Submodes IIA1 and IIA2 otherwise correspond to the first two described Mode I submodes, with and without collection of water. Of course, collected water could be released (as it could be in Mode I) by connecting pipe 24 to pump P1 intake instead of discharge ports.

Submodes IIB1 and IIB2 otherwise correspond to the second pair of Mode I submodes, without and with offshore fluidization, respectively. The latter (FIG. 9B) is less likely (broken arrows) when conditions suggest beach fluidization, such as when a storm has eroded away a substantial part of pre-existing beach soil.

The overall objective is to prevent beach and related erosion by natural forces, especially in extreme regions of their operating spectrum. The foregoing operating modes are not all-inclusive and not necessarily so exclusive as they may appear. Various conditions may require other mixing or matching of dewatering and fluidization.

Although fluidization of non-cohesive subsoil, such as sand, is exemplified above with water as the fluid of choice, air, or a mixture of air and water may be substituted whenever preferable. Air may be supplied through pipe 24 (characterized above as an exhaust pipe for water collected by dewatering the subsoil). Airflow and/or intermittent air and water flow is often helpful in initial removal of excessive deposits of overlying subsoil or other obstructions.

Sizing and distribution of openings in foraminous pipes for desired flow therethrough may vary greatly, as in diverse subsoils. Dewatering pipes may have openings uniformly distributed throughout, whereas fluidizing pipes may have openings mainly (or exclusively) at the sides because lower openings tend to settle the pipe into the subsoil, whereas higher openings enable the fluid to escape upward quickly and with reduced overall fluidizing effect. A multi-purpose pipe (e.g., one functioning part of the time for dewatering and part of the time for fluidization) is almost by definition suited less well to either such use than are pipes tailored to one or the other. Hence, the showing herein of pipes lacking foramina above center.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

The claimed invention:

1. Beach stabilization method comprising the steps of burying first foraminous piping means in beach subsoil in the vicinity of the mean low water contour, withdrawing water via the first foraminous piping means under the beach to dewater the beach subsoil and favor beach accretion, burying second foraminous piping means in subsoil between the beach and the furthest onshore runup location above the beach, burying third foraminous piping means in subsoil offshore and injecting into the subjacent subsoil through the third piping means water withdrawn from the subsoil via at least one of the first and second piping means to fluidize the overlying subsoil and increase the concentration of subsoil suspended in the overlying water, and under stormy conditions withdrawing water via the second foraminous means to dewater the onshore subsoil and favor the deposition of subsoil suspended in water onrushing onshore and thereby oppose erosion therefrom.

2. Beach stabilization method according to claim 1, plus the steps of including valving and pumping means connected to the piping means, and operating the valving and pumping means to assure subsoil dewatering.

3. Beach stabilization method according to claim 2, plus the step of operating the valving and pumping means to assure subsoil fluidization offshore.

4. Beach stabilization apparatus including substantially parallel foraminous pipes emplaced along a shoreline, comprising one foraminous pipe underlying beach land near mean low water, a second foraminous pipe underlying an onshore location in the vicinity of furthest storm water runup, a third foraminous pipe underlying nearby offshore subsoil, and non-foraminous piping means interconnecting to the foraminous pipes and provided with pumping means, being thereby adapted to dewater adjacent subsoil by withdrawing water therefrom via one or more of the foraminous pipes, and to fluidize adjacent subsoil by injecting water thereinto via one or more of the foraminous pipes.

5. Beach stabilization apparatus according to claim 4, plus a pipe directed further offshore than the nearby offshore location of the third foraminous pipe, being thereby adapted to receive water from such nearby offshore location for use in fluidizing subsoil via one or more of the foraminous pipes, or to discharge water from subsoil dewatered via one or more of the foraminous pipes.

6. Beach stabilization method comprising the steps of burying first foraminous piping means in beach subsoil in the vicinity of the mean low water contour, burying second foraminous piping means in subsoil between the beach and the furthest onshore runup location, burying third foraminous piping means in subsoil offshore, and under stormy conditions withdrawing water via the second foraminous means to dewater the onshore subsoil and favor the deposition of subsoil suspended in water onrushing onshore, and thereby oppose erosion therefrom, and injecting water into adjacent subsoil via at least one of the first and third piping means to fluidize the overlying subsoil and increase the subsoil suspended in the overlying water.

7. Beach stabilization method according to claim 6, including valving and pumping the water and controlling its flow to produce the desired dewatering and desired fluidization.

8. Beach stabilization method according to claim 7, including the steps of dewatering the onshore location via the second piping means, and injecting the resulting water via the first and third piping means into adjacent subsoil to fluidize it and thus to reduce erosion from the beach under stormy conditions.

9. Beach stabilization system convertible between a normal mode of operation useful during good weather and an emergency mode of operation useful during stormy weather, comprising an array of substantially parallel lengths of buried foraminous piping, including a first such piping length underlying beach land at about the level of mean low water, a second such piping length underlying an onshore location at about furthest storm runup, and a third such piping length underlying a nearby offshore location;

aligned non-foraminous piping directly joining the second and third to the first of the foraminous piping lengths, flow-control valves at respective piping junctions, and pumping means adapted to provide water flow into or out from respective foraminous piping lengths from or into adjacent subsoil.

10. Beach stabilization system according to claim 9, including a nearby water reservoir and an added length of non-foraminous piping connecting the piping array to the reservoir for storage of excess water removed from the subsoil and as a source of water for injection into the subsoil.

11. Beach stabilization system according to claim 9, including an additional length of non-foraminous piping extending offshore from a connection with the offshore component of the piping array.

12. Method of operating the piping array of claim 9 in such emergency mode as a beach stabilization system, comprising the steps of dewatering the beach and the further onshore location via the first and second foraminous piping length, respectively, and fluidizing offshore subsoil via the third such piping length for transport onto the beach.

13. Method according to claim 12, including storing in a nearby reservoir excess water being currently obtained by such dewatering, for later injection into the subsoil to fluidize it.

14. Method according to claim 13, including discharging from the array to a location further offshore water being currently obtained by such dewatering, as not needed for later injection into the subsoil to fluidize it.

15. Method of operating the piping array of claim 9 in such normal mode as a beach stabilization system, comprising the steps of fluidizing offshore subsoil via the first and third foraminous piping lengths, respectively, for transport onto the beach, and dewatering the further onshore location via the second such piping length.

16. Method according to claim 15, including obtaining from a nearby reservoir stored water previously obtained from the array, and using it to augment water currently being obtained by such dewatering, for injection into the subsoil to fluidize it.

17. Method according to claim 15, including obtaining water from a location further offshore, and using it to augment water currently being obtained by such dewatering, for injection into the subsoil to fluidize it.

* * * * *